US007424351B2

(12) United States Patent
Noguchi

(10) Patent No.: US 7,424,351 B2
(45) Date of Patent: Sep. 9, 2008

(54) CONTROL UNIT AND DATA TRANSMITTING METHOD

(75) Inventor: Kiyoshige Noguchi, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 35 days.

(21) Appl. No.: 11/065,053

(22) Filed: Feb. 25, 2005

(65) Prior Publication Data

US 2005/0190467 A1 Sep. 1, 2005

(30) Foreign Application Priority Data

Feb. 27, 2004 (JP) ..... P2004-055045

(51) Int. Cl.
*G01M 15/05* (2006.01)
*G06F 9/00* (2006.01)

(52) U.S. Cl. ..... 701/35; 340/438

(58) Field of Classification Search ..... 701/29–35, 701/1; 714/13–18; 340/425.5, 428, 438; 307/9.1, 10.1, 10.4, 10.5, 10.6
See application file for complete search history.

(56) References Cited

U.S. PATENT DOCUMENTS

2002/0032506 A1 3/2002 Tokitsu et al.
2003/0033067 A1* 2/2003 Arita et al. ..... 701/48

FOREIGN PATENT DOCUMENTS

| | | | |
|---|---|---|---|
| CA | 2 229 425 | A1 | 9/1999 |
| EP | 0 961 238 | A1 | 12/1999 |
| EP | 1 302 750 | A2 | 4/2003 |
| JP | 2002-70637 | | 3/2002 |
| JP | 2003-248513 | | 9/2003 |

OTHER PUBLICATIONS

European Search Report dated Jul. 14, 2006.

* cited by examiner

*Primary Examiner*—Jack W Keith
*Assistant Examiner*—Edward Pipala
(74) *Attorney, Agent, or Firm*—McGinn IP Law Group, PLLC

(57) ABSTRACT

A control unit receives a data request signal transmitted from a data recording apparatus, and then transmits a control parameter, which corresponds to the data request signal, out of control parameters used to execute control of a vehicle to the data recording apparatus. In this case, a transmission state of a transmitting section at a time of shutdown is stored as a communication history. Therefore, when the communication history is stored in a storing section, the transmission state at the time of shutdown is restored in a starting process executed after a power supply is turned ON, based on the read communication history.

15 Claims, 5 Drawing Sheets

| MODE FILE | ACQUIRED CONTENTS | ACQUIRING CONDITION |
|---|---|---|
| A | 1. ENGINE SPEED<br>2. VEHICLE SPEED<br>3. INTAKE PIPE PRESSURE<br>4. IGNITION ADVANCED ANGLE<br>5. FUEL INJECTION INTERVAL<br>6. IDLE CONTROL VALVE CONTROL AMOUNT<br>7. ENGINE COOLANT TEMPERATURE | TRIGGER CONDITIONS:<br>(1) ENGINE SPEED = 0rpm<br>(2) CHANGED AMOUNT OF ENGINE SPEED EXCEEDS PREDETERMINED VALUE<br>RECORDING TIME:<br>(1) 10 MINUTES BEFORE AND AFTER CONDITIONS ARE SATISFIED<br>(2) 10 MINUTES BEFORE AND AFTER CONDITIONS ARE SATISFIED<br>SAMPLING RATE:<br>(1) HIGHEST<br>(2) HIGHEST |
| B | 1. ENGINE SPEED<br>2. VEHICLE SPEED<br>3. INTAKE PIPE PRESSURE<br>4. IGNITION ADVANCED ANGLE<br>5. FUEL INJECTION INTERVAL<br>6. IDLE CONTROL VALVE CONTROL AMOUNT<br>7. ENGINE COOLANT TEMPERATURE<br>8. STARTING FUEL CONTROL<br>9. STARTING IGNITION CONTROL<br>10. BATTERY VOLTAGE | TRIGGER CONDITIONS:<br>(1) ON OF IGNITION SWITCH<br>(OR TURN ON OF RECORDING SYSTEM)<br>RECORDING TIME:<br>(1) 10 MINUTES AFTER CONDITIONS ARE SATISFIED<br>SAMPLING RATE:<br>(1) 1 MINUTE FROM START OF RECORDING → HIGHEST,<br>1 MINUTE TO 10 MINUTES→ EVERY 1 SECOND |
| C | 1. ENGINE SPEED<br>2. VEHICLE SPEED<br>3. INTAKE PIPE PRESSURE<br>4. IGNITION ADVANCED ANGLE<br>5. FUEL INJECTION INTERVAL<br>6. G SENSOR VALUE<br>7. AT GEAR POSITION<br>8. IGNITION LEARNED VALUE (LEARNING MAP)<br>9. FUEL LEARNED VALUE (LEARNING MAP)<br>10. PERIPHERAL INFORMATION | TRIGGER CONDITIONS:<br>(1) MISFIRE DECISION<br>(2) START AND END OF DATA ACQUISITION (CONTENTS 8, 9, 10)<br>RECORDING TIME:<br>(1) 10 MINUTES BEFORE CONDITIONS ARE SATISFIED<br>(2) ONCE WHEN CONDITIONS ARE SATISFIED<br>SAMPLING RATE:<br>(1) HIGHEST |
| D | 1. ENGINE SPEED<br>2. VEHICLE SPEED<br>3. INTAKE PIPE PRESSURE<br>4. IGNITION ADVANCED ANGLE<br>5. FUEL INJECTION INTERVAL | TRIGGER CONDITIONS:<br>(1) MIL TURNED ON<br>RECORDING TIME:<br>(1) 10 MINUTES BEFORE AND AFTER CONDITIONS ARE SATISFIED<br>SAMPLING RATE:<br>(1) EVERY 1 SECOND |
| ⋮ | ⋮ | ⋮ |

FIG. 4

| MODE FILE | ACQUIRED CONTENTS | ACQUIRING CONDITION |
|---|---|---|
| A | 1. ENGINE SPEED<br>2. VEHICLE SPEED<br>3. INTAKE PIPE PRESSURE<br>4. IGNITION ADVANCED ANGLE<br>5. FUEL INJECTION INTERVAL<br>6. IDLE CONTROL VALVE CONTROL AMOUNT<br>7. ENGINE COOLANT TEMPERATURE | TRIGGER CONDITIONS:<br>(1) ENGINE SPEED = 0rpm<br>(2) CHANGED AMOUNT OF ENGINE SPEED EXCEEDS PREDETERMINED VALUE<br>RECORDING TIME:<br>(1) 10 MINUTES BEFORE AND AFTER CONDITIONS ARE SATISFIED<br>(2) 10 MINUTES BEFORE AND AFTER CONDITIONS ARE SATISFIED<br>SAMPLING RATE:<br>(1) HIGHEST<br>(2) HIGHEST |
| B | 1. ENGINE SPEED<br>2. VEHICLE SPEED<br>3. INTAKE PIPE PRESSURE<br>4. IGNITION ADVANCED ANGLE<br>5. FUEL INJECTION INTERVAL<br>6. IDLE CONTROL VALVE CONTROL AMOUNT<br>7. ENGINE COOLANT TEMPERATURE<br>8. STARTING FUEL CONTROL<br>9. STARTING IGNITION CONTROL<br>10. BATTERY VOLTAGE | TRIGGER CONDITIONS:<br>(1) ON OF IGNITION SWITCH (OR TURN ON OF RECORDING SYSTEM)<br>RECORDING TIME:<br>(1) 10 MINUTES AFTER CONDITIONS ARE SATISFIED<br>SAMPLING RATE:<br>(1) 1 MINUTE FROM START OF RECORDING → HIGHEST,<br>1 MINUTE TO 10 MINUTES→ EVERY 1 SECOND |
| C | 1. ENGINE SPEED<br>2. VEHICLE SPEED<br>3. INTAKE PIPE PRESSURE<br>4. IGNITION ADVANCED ANGLE<br>5. FUEL INJECTION INTERVAL<br>6. G SENSOR VALUE<br>7. AT GEAR POSITION<br>8. IGNITION LEARNED VALUE (LEARNING MAP)<br>9. FUEL LEARNED VALUE (LEARNING MAP)<br>10. PERIPHERAL INFORMATION | TRIGGER CONDITIONS:<br>(1) MISFIRE DECISION<br>(2) START AND END OF DATA ACQUISITION (CONTENTS 8, 9, 10)<br>RECORDING TIME:<br>(1) 10 MINUTES BEFORE CONDITIONS ARE SATISFIED<br>(2) ONCE WHEN CONDITIONS ARE SATISFIED<br>SAMPLING RATE:<br>(1) HIGHEST |
| D | 1. ENGINE SPEED<br>2. VEHICLE SPEED<br>3. INTAKE PIPE PRESSURE<br>4. IGNITION ADVANCED ANGLE<br>5. FUEL INJECTION INTERVAL | TRIGGER CONDITIONS:<br>(1) MIL TURNED ON<br>RECORDING TIME:<br>(1) 10 MINUTES BEFORE AND AFTER CONDITIONS ARE SATISFIED<br>SAMPLING RATE:<br>(1) EVERY 1 SECOND |
| ⋮ | ⋮ | ⋮ |

CONTROL UNIT AND DATA TRANSMITTING METHOD

The present application claims foreign priority based on Japanese Patent Application P.2004-055045, filed Feb. 27, 2004, the contents of which are incorporated herein by reference.

BACKGROUND OF THE INVENTION

The present invention relates to a control unit and a data transmitting method, and more particularly, an approach of communicating the data between a data recording apparatus and a control unit.

In the prior art, a data recording apparatus, for downloading a control parameter of a control unit mounted on the vehicle and recording the parameter in order to identify a faulty condition of the vehicle, is known. For example, JP-A-2002-070637 discloses a data recording apparatus for reliably and effectively recording the data of the control unit. In the data recording apparatus, various data in the control unit on the vehicle side are chronologically sampled and then the acquired sampling data are stored in the SRAM. Then, when the conditions under which the data that are useful for identifying the faulty condition of the vehicle will be obtained are satisfied, a series of sampling data stored in the SRAM are stored in the data recording section.

Meanwhile, since the control unit is prepared for the purpose of executing the control of the vehicle, the data recording apparatus must instruct the control unit to transmit the data in order to get the data of the control unit. Therefore, the data recording apparatus cannot acquire the data until such data recording apparatus instructs the control unit to transmit the data every time when the control unit is started in response to the start of the vehicle. From the viewpoint of improving the reliability of the recorded data, it is preferable that the data recording apparatus should record the data at the time of starting the vehicle, i.e., at the time of starting the control unit. However, since the control unit takes a time to some extent after it receives the instruction for data transmission and then prepares the transmitting condition to transmit the necessary data in response to this instruction, such a disadvantage arises that the control unit fails to record the data immediately after the starting.

SUMMARY OF THE INVENTION

The present invention has been made in view of such circumstances, and an object of the present invention is to provide a control unit and a data transmitting method improved in responsibility to a recording operation of a data recording apparatus.

In order to overcome such problem, a first aspect of the present invention provides a control unit that is capable of transmitting/receiving information to/from a data receiving apparatus to execute control of a vehicle. The control unit comprises a receiving section for receiving a data request signal transmitted from the data recording apparatus; a transmitting section for transmitting a control parameter, which corresponds to the data request signal, out of control parameters used to execute the control of the vehicle to the data recording apparatus; and a storing section for storing a transmission state of the transmitting section, which transmits the control parameter, at a time of shutdown as a communication history. In the control unit, when the communication history is stored in the storing section, the transmitting section reads the communication history from the storing section in a starting process executed after a power supply is turned ON, and then restores the transmission state at the time of shutdown based on the read communication history.

Here, in the first aspect, it is preferable that, when the receiving section received a signal to an effect that the transmission state should be continued from the data recording apparatus, the transmitting section should restore the transmission state.

Also, a second aspect of the present invention provides a method that transmits data to a data recording apparatus, in a control unit that is capable of transmitting/receiving information to/from the data recording apparatus to execute control of a vehicle. This method of transmitting data, comprises a first step of receiving a data request signal transmitted from the data recording apparatus; a second step of transmitting a control parameter, which corresponds to the data request signal, out of control parameters used to execute the control of the vehicle to the data recording apparatus; and a third step of storing a transmission state of a transmitting section, which transmits the control parameter, at a time of shutdown as a communication history. In the method, when the communication history is stored, the second step restores the transmission state at the time of shutdown in a starting process executed after a power supply is turned ON, based on the stored communication history.

Here, in the second aspect, it is preferable that, when a signal to an effect that the transmission state should be continued is received from the data recording apparatus, the second step should restore the transmission state.

According to the present invention, when the communication history is stored in the storing section, the instruction to the effect that the transmission state should be continued is issued from the data recording apparatus in the starting process executed after the power supply is turned ON, and then the transmission state at the time of shutdown is restored based on the stored communication history. In this fashion, because the communication state at the time of shutdown is restored by the control unit itself, the responsibility of the data communication between the data recording apparatus and the control unit can be improved rather than the case where the transmission state is set based on the instruction from the data recording apparatus. Therefore, the control unit can execute the data acquisition immediately after the control unit is started. As a result, the data recording apparatus can record the necessary data without fail and also the reliability of the recorded data can be improved.

BRIEF DESCRIPTION OF THE DRAWINGS

FIG. 4 is an explanatory view showing an example of a mode file.

DESCRIPTION OF THE PREFERRED EMBODIMENTS

Figure 1:
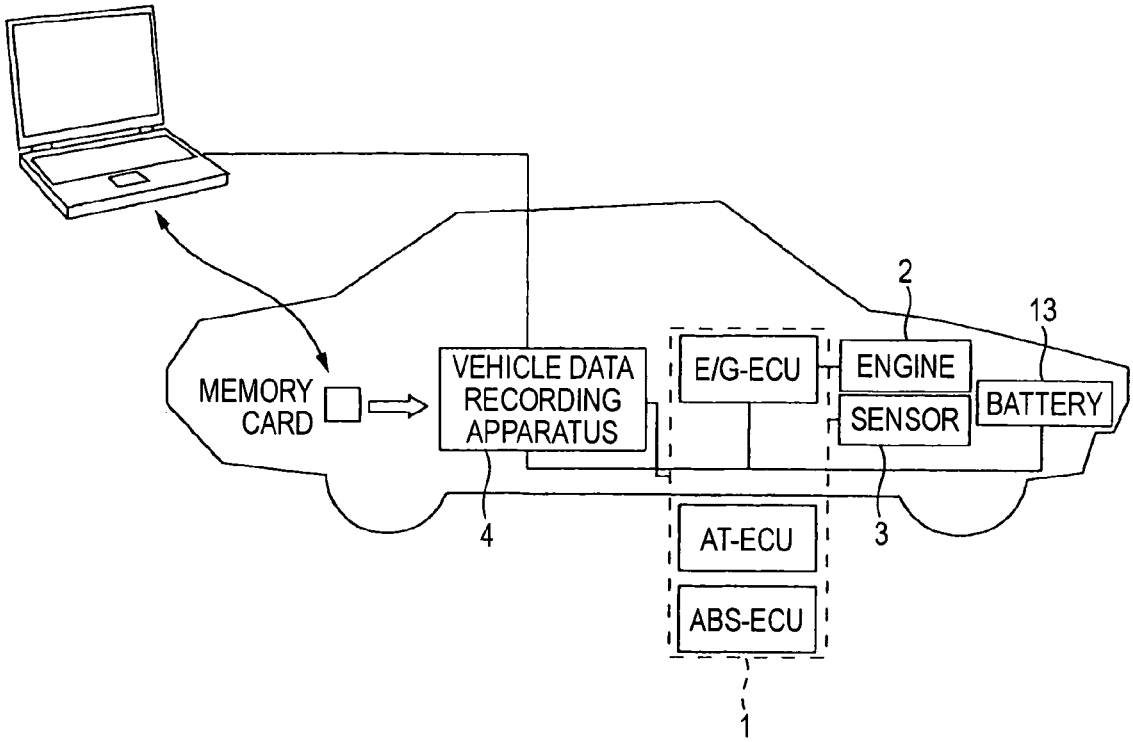
FIG. 1 is an explanatory view of a vehicle including a control unit according to an embodiment of the present invention.

FIG. 1 is an explanatory view of a vehicle including a control unit according to an embodiment of the present Invention. An electronic control unit 1 (referred simply to as an "ECU" hereinafter) for executing control of various units is installed into the vehicle. As the ECU 1 installed into the vehicle, an engine control unit (referred simply to as an "E/G-ECU" hereinafter) for executing control of an engine 2, a transmission control unit (AT-ECU) for executing control of the automatic transmission, an ABS control unit (ABS-ECU) for executing control of the anti-lock brake system, and the like are considered. In the present embodiment, E/G-ECU will be explained mainly among these control units, but the present invention can be applied similarly to AT-ECU and ABS-ECU. In this application, the term "ECU" is used to signify a general term for various control units necessary for control of the vehicle.

Respective control units constituting the ECU 1 are connected mutually via the K-line (one serial communication standard) or the CAN (Controller Area Network). Respective control units can share mutual information by transferring the information via this communication line. Also, as shown in FIG. 1, a data recording apparatus 4 (referred simply to as a "recording apparatus" hereinafter) except the ECU 1 is connected to this communication line. A particular configuration of the recording apparatus 4 will be explained later, but this recording apparatus 4 is such an apparatus that records various data about the vehicle (referred to as "vehicle data" hereinafter). In the situation that the recording apparatus 4 is connected to the communication line, the information transmission can be performed between the ECU 1 and the recording apparatus 4. Thus, the recording apparatus 4 can acquire and record the vehicle data by executing the data communication with the ECU 1. In this case, the situation that the recording apparatus 4 is installed into the vehicle is illustrated in FIG. 1. However, the recording apparatus 4 is installed into the vehicle as the case may be since such recording apparatus 4 can be detachably attached to the vehicle.

As the ECU 1, a microcomputer composed of CPU, ROM, RAM, input/output interface, etc. may be employed. The ECU 1 executes calculation of various controlled variables in compliance with the previously-set control program to execute the control of the vehicle. Then, the controlled variables calculated in this calculation are output to various actuators. The sensor-sensed signals output from various sensors 3 are input into the ECU 1 to execute such calculation. As the sensors of this type, there are listed an intake air volume sensor, a boost pressure sensor, a speed sensor, an engine speed sensor, a coolant temperature sensor, an acceleration sensor (G sensor), and the like. In this case, all the sensor-sensed signals output from these sensors 3 are not always input commonly into respective control units constituting the ECU 1. The sensor-sensed signals required for individual control units are enough to execute the control. Also, in addition to the calculation of these controlled variables, the self-diagnosis program used to diagnose the fault of each portion in the controlled object is installed into the ECU 1 and diagnoses automatically operating conditions of the microcomputer, the sensors, etc. at an appropriate period. When the fault is found by this diagnosis, the ECU 1 generates the diagnosis code to deal with the fault contents and then stores this code in a predetermined address of a back-up RAM in the ECU 1. Also, the ECU 1 executes an alarming process such that the MIL lamp is caused to turn ON or turn ON/OFF, or the like, as the case may be.

Figure 2:
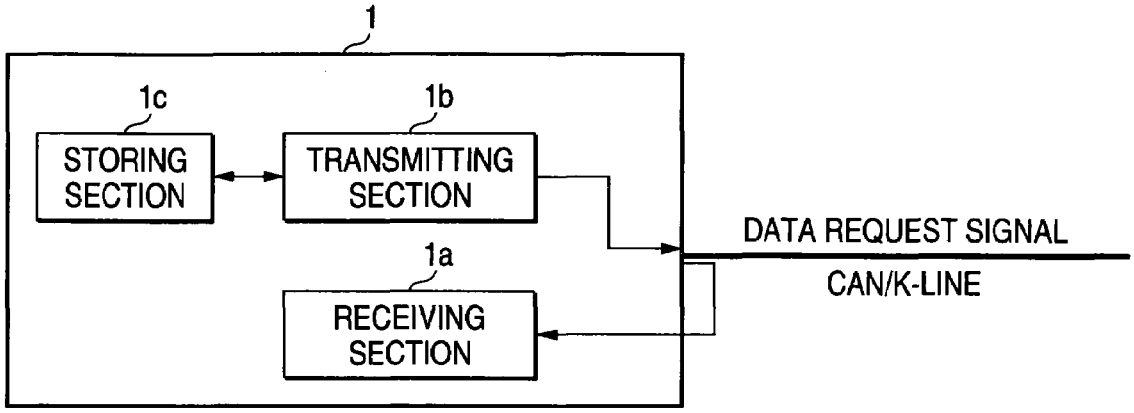
FIG. 2 is a block diagram showing a functional system configuration of an ECU 1.

FIG. 2 is a block diagram showing a functional system configuration of the ECU 1 according to the present embodiment. The ECU 1 fulfills a secondary function of executing the data communication with the recording apparatus 4 as well as a function of executing the control of the vehicle. When the ECU 1 to execute the data communication is viewed functionally, this ECU 1 has a receiving section 1*a*, a transmitting section 1*b*, and a storing section 1*c*. The receiving section 1*a* receives a data request signal transmitted from the recording apparatus 4. This data request signal is such a signal that instructs the ECU 1 to transmit the control parameter that the recording apparatus 4 records, i.e., the control parameter that the ECU 1 transmits to the recording apparatus 4. The transmitting section 1*b* transmits the control parameters, which correspond to the data request signal among the control parameters calculated by the ECU 1, to the recording apparatus 4. The storing section 1*c* stores the transmission state when the transmitting section 1*b* that transmits the control parameters is shut down, as the communication history. From the viewpoint of preventing the erase of the communication history owing to the shutting off of the power supply following the shut down, a back-up RAM constituting the microcomputer is used as the storing section 1*c*. When the communication history is stored in the storing section 1*c*, the transmitting section 1*b* reads the communication history stored in the storing section 1*c* in the starting process that is executed after the power supply is turned ON, and then restores, the transmission state in the shutdown based on this communication history.

Next, the recording apparatus 4 for recording the vehicle data will be explained hereunder. As the case where the recording apparatus 4 is installed into the vehicle, the case of periodic inspection, the case where the user brings the vehicle into the service shop when he or she found any trouble, or the like may be considered. In the former case, the test run of the vehicle is carried out by the service man. In this case, the recording apparatus 4 acquires the vehicle data in a test run period on demand, and records the acquired vehicle data as the case may be. Also, in the latter case, the vehicle is returned once to the user except for the case where the service man can easily identify the trouble. In this case, the recording apparatus 4 acquires the vehicle data at any time in the situation that the vehicle is normally driven by the user, and records the acquired vehicle data if necessary. After the test run conducted by the service man is finished or when the vehicle is carried into the service shop once again, the recording apparatus 4 is removed from the vehicle. Then, in order to decide whether or not the fault arose in the vehicle or to identify the cause when the fault arose, the vehicle data recorded in the recording apparatus 4 are employed.

As the vehicle data that the recording apparatus 4 records, control parameters of the ECU 1 are considered. Here the controlled variables calculated in the ECU 1 are assumed as the "control parameters", but parameters (engine speed (rpm), speed (km/h), etc.) and learned values (control learning map) used to calculate the controlled variables are also contained in the controlled variables.

Figure 3:
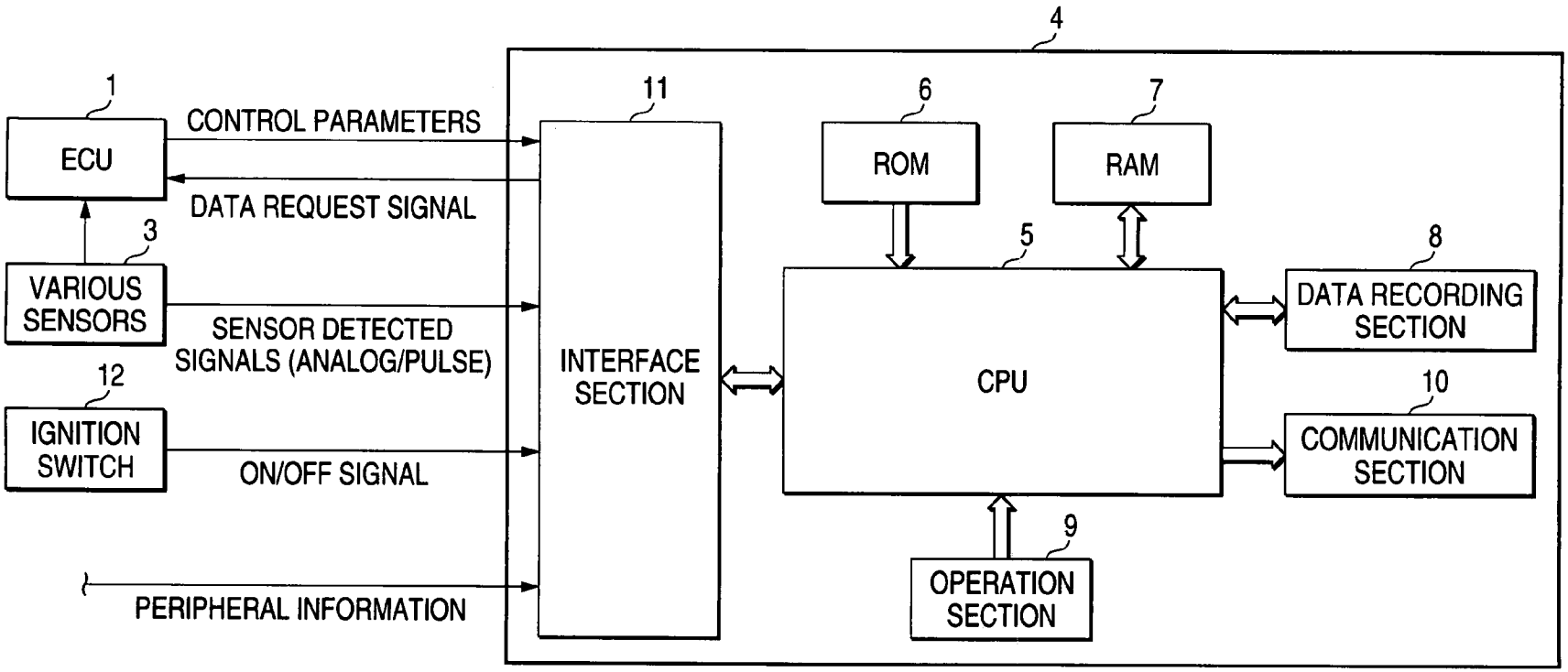
FIG. 3 is a block diagram showing a system configuration of a recording apparatus.

FIG. 3 is a block diagram showing a system configuration of the recording apparatus 4. The recording apparatus 4 for storing the vehicle data is composed mainly of a CPU 5. Then, a ROM 6, a RAM 7, a data recording section 8, an operation section 9, a communication section 10, and an interface section 11 are connected to buses that are connected to the CPU 5. The CPU 5 conducts control of the overall recording apparatus 4, and reads the control program stored in the ROM 6 and then executes the process in compliance with this program. More concretely, the CPU 5 chronologically collects the vehicle data output from the vehicle side at a predetermined sampling rate, and then stores the collected vehicle data in the data recording section 8. The RAM 7 constitutes a work area that stores temporarily various process data executed by the CPU 5, etc., and also has a function as a buffer that temporarily records the vehicle data chronologically collected.

A series of vehicle data recorded in the RAM 7 are recorded in the data recording section 8, that the external systems can access, on the assumption that conditions described later are satisfied. In the present embodiment, in view of the versatility of the data recorded in the data recording section 8, the card type nonvolatile memory that can be detachably attached to the recording apparatus 4, e.g., the flash memory type memory card, is used as the data recording section 8. For this purpose, the recording apparatus 4 has a socket (or a drive) via which the CPU 5 can access the memory card directly/indirectly. In the case where the recording apparatus 4 is incorporated into the vehicle, the memory card is inserted previously into the socket. Thus, the CPU can record the vehicle data on the memory card that corresponds to the data recording section 8, and can read the information recorded on the memory card. As the memory card of this type, various storing media such as SmartMedia, SD memory card, and so on can be employed. The memory capacities of these memory cards are set variously in a range of 8 MB to 1 GB, and thus the memory card having a predetermined memory capacity can be employed at user's option.

The mode files read by the CPU 5 and used are recorded previously in the memory card serving as the data recording section 8. Although details of the mode files will be described later, the conditions applied to record the vehicle data useful for identifying the faulty conditions are set appropriately in the experiment or the simulation after the faulty conditions that will be caused in the vehicle are assumed. That is, basic information used when the recording apparatus 4 acquires/records the vehicle data are described in the mode files, and the recording apparatus 4 records the vehicle data in accordance with the mode files.

The operation section 9 is structured by a remote controller to which operation switches are provided, and this remote controller can be operated by the driver. The operation signal is output from the operation section 9 to the CPU 5 when the operation switches are operated by the driver. Thus, the CPU 5 records the vehicle data recorded in the RAM 7 in the data recording section 8. When the recording of the vehicle data is completed satisfactorily, the communication section 10 informs the user of the completion of recording. In the present embodiment, the communication section 10 is mainly structured by LEDs, and is controlled to turn ON or turn ON/OFF when the recording of the vehicle data that are described in the acquiring conditions is appropriately ended. Thus, the communication section 10 can inform effectively the user of the recording completion of the vehicle data. In this case, the communication section 10 may be composed of the CRT or the liquid crystal display, or the speaker, or the like, and various configurations that are capable of informing the driver of the recording completion may be employed.

The interface section 11 contains various interfaces that can transfer the data between the vehicle and the recording apparatus 4. For example, the recording apparatus 4 is connected to the CAN or the K-Line on the vehicle side via this interface section 11, and can hold two-way data communication with the ECU 1 on the vehicle side. Also, the sensor-sensed signals output from various sensors 3 provided to the vehicle may be input into the interface section 11 directly or indirectly via the ECU 1, or a signal (ON signal/OFF signal) that is generated in synchronism with ON or OFF of an ignition switch 12 may be input into the interface section 11. In addition, the recording apparatus 4 can execute two-way communication with the general-purpose computer (external PC) as the external system attached externally via the interface section 11.

The recording apparatus 4 is connected to a battery 13 provided to the vehicle side (see FIG. 1), and is operated by an electric power supplied from the battery 13. In this case, in order to maintain the power supply necessary for the operation of the recording apparatus 4 in the situation that the supply of the electric power is cut off, a sub-battery (not shown) is provided to the recording apparatus 4. For example, this sub-battery is composed of a capacitor that has a predetermined electrostatic capacity, or the like. The electric power accumulated in the sub-battery is supplied appropriately to various circuits constituting the recording apparatus 4 as soon as the electronic connection between the battery 13 and the recording apparatus 4 is disconnected. Also, although not shown in FIG. 3, a clock function of indicating current day/time and a timer function of sensing a timing of a predetermined period are provided to this recording apparatus 4.

Then, data communication procedures between the recording apparatus 4 and the ECU 1 will be explained hereunder. In the state that the recording apparatus 4 is initially installed into the vehicle, the power supply of this recording apparatus 4 is turned OFF and then such power supply is turned ON in synchronism with the start of the vehicle or prior to the start of the vehicle. When the power supply is turned ON and the system is started, first the recording apparatus 4 executes the setting of the operating states. This setting of the operating states is carried out based on the mode file recorded in the data recording section 8.

FIG. 4 is an explanatory view showing an example of the mode file. The mode file is composed of the acquired contents and the acquiring conditions. The acquired contents are classifications of the vehicle data as the recorded object. The acquiring conditions are conditions that are applied to acquire/record the vehicle data in response to the acquired contents. A sampling rate, trigger conditions, a recording time, etc. correspond to the acquiring conditions. The sampling rate is a period at which the vehicle data are collected, and various periods are set in response to the acquired contents. The trigger conditions are the conditions that are applied to record the acquired vehicle data from the RAM 7 to the data recording section 8. As the trigger conditions, predetermined points (e.g., speed=0 km/h, engine speed=0 rpm, and the like) in the time-dependent transition of the vehicle data, a point of time when the ignition switch is turned ON, a point of time when the failure code such as the misfire decision is generated, start and end points of the data acquisition, a point of time when the MIL lamp is turned ON, etc. may be listed. The recording time is a time length of the vehicle data that are recorded from the RAM 7 to the data recording section 8. For example, 10 minute before and after the trigger conditions are satisfied, etc. may be listed.

In an example shown in FIG. 4, a mode file A is such a mode file that the rough idle is assumed as the faulty condition. In accordance with this mode file A, the recording apparatus 4 gets the vehicle data such as engine speed, vehicle speed, intake pipe pressure, ignition advanced angle, fuel injection interval, controlled amount of the auxiliary air control valve, engine coolant temperature, etc. at a highest (e.g., 10 msec) sampling rate. Also, the vehicle data collected over 10 minute before and after the timing at which the trigger conditions are satisfied are recorded in the data recording section 8, while using as the trigger conditions the event that the engine speed becomes 0 rpm in a vehicle data collecting period. Alternately, the vehicle data collected over 10 minute be ore and after the timing at which the trigger conditions are satisfied are recorded in the data recording section 8, while using as the trigger conditions the event that a changed amount of the engine speed exceeds a predetermined value.

Meanwhile, a mode file B is such a mode file that the defective engine start is assumed as the faulty condition, and a mode file C is such a mode file that the abnormal vibration such as the surge, or the like is assumed as the faulty condition. In contrast, a mode file D is not prepared as the mode file in which the particular faulty condition is assumed, and is set as the mode file corresponding to broad applications that must acquire the lowest minimum vehicle data in various faulty conditions. In this manner, a plurality of files each of which corresponds to a different faulty condition are present in the mode files. For this reason, when the recording apparatus 4 is incorporated into the vehicle, the mode file must be recorded on the memory card as the premise after the mode file corresponding to the faulty condition of the vehicle into which the recording apparatus 4 is incorporated is appropriately selected. While referring to the user's explanation of the faulty condition and the diagnosis codes stored in the back-up RAM of the ECU 1, the selection and the recording of the mode files are executed by the service man who operates the external PC.

Here, the setting of the operating state based on the mode file may be executed once at the starting time immediately after the recording apparatus 4 is incorporated into the vehicle, and then the operating state is set by referring to the operating history at the subsequent starting times. This operating history is the information that is recorded in the data recording section 8 at the time of shutdown of the recording apparatus 4, and the operating states of the recording apparatus 4 at the time of shutdown are described in the operating history. The lowest minimum contents required for the recording apparatus 4 in the subsequent starting to restore the operating state at the time of shutdown are recorded in the operating history. As a result, the recording apparatus 4 can restore the same operating state as that at the time of preceding shutdown, by referring to the operating history. According to the setting of the operating state using the operating history, not only the continuity of the operating state can be kept in respective driving cycles but also the operating state can be set in a short time since a quantity of information is small in contrast to the mode file.

When the operating state is set, the recording apparatus 4 outputs the data request signal having the content shown in following (1) or (2) to the ECU 1.

(1) Data Request Signal that Defines the Acquired Contents Directly

This data request signal is output when the operating history has not been stored in the recording apparatus 4, i.e., when the recording apparatus 4 has never been operated and the recording operation of the vehicle data is executed for the first time.

(2) Data Request Signal that Defines that the Transmitting Condition Should Still be Continued This data request signal is output when the operating history has been stored in the recording apparatus 4, i.e., when the recording operation of the vehicle data has been executed once or more.

Meanwhile, when the power supply of the ECU 1 is turned ON simultaneously with the start of the vehicle, the ECU 1 reads the communication history from the back-up RAM corresponding to the storing section 1*c* against the communication with the recording apparatus 4. The transmission states of the ECU 1, which transmits the control parameters, at the time of shutdown are described, and more concretely the types of the control parameters that the ECU 1 transmitted, the transmitting method, etc. are described.

When the control parameters have already been transmitted to the recording apparatus 4, i.e., when the communication history has already been stored, the ECU 1 reads the communication history and then identifies the transmission state of the transmitting section 1*b* at the time of preceding shutdown based on the communication history. Then, when the ECU 1 receives the data request signal transmitted from the recording apparatus 4, it stands by to restore the identified transmission state. In this state, since the recording operation of the vehicle data has been executed once or more, the data request signal to the effect that the transmission state from the recording apparatus 4 is still continued Is output (above (2)). The ECU 1 restores the transmission state at the time of shutdown based on the communication in response to this data request signal. As a result, the control parameters of the same types as those at the time of preceding shutdown are also transmitted in compliance with the same communicating method.

In contrast, when the control parameters have never been transmitted to the recording apparatus 4, i.e., when the communication history has not been stored, the ECU 1 stands by to establish the data communication with the recording apparatus 4. In this case, because the recording operation of the vehicle data has never been executed, the data request signal that defines the acquired contents directly is output from the recording apparatus 4 (above (1)). As a result, the ECU 1 transmits the control parameters, which correspond to the data request signal, out of the control parameters used to execute the control of the vehicle, in compliance with the predetermined communication method (e.g., the order of types requested as the acquired contents). Now, the ECU 1 is running the normal control during when such ECU 1 outputs the vehicle data, and outputs the control parameters on a time-dependent basis until its own operation is ended.

The recording apparatus 4 acquires the control parameters transmitted from the ECU 1 at a predetermined sampling rate, and then chronologically records the acquired control parameters in the RAM 7. In this case, when the vehicle data except for the control parameters of the ECU 1, i.e., the sensor-sensed signals, the peripheral information, etc. are contained in the acquired contents, the recording apparatus 4 also acquires these data via the interface section 11 and chronologically stores them in the RAM 7. In the case where the data corresponding to the acquired contents, e.g., the engine speed, are present in both the control parameters (calculated values) of the ECU 1 and the sensor-sensed signals, the recording apparatus 4 can acquire the sensor-sensed signals together with the control parameters and then record both data in the RAM 7. Also, the peripheral information are information with regard to the peripheral outside of the vehicle. An atmospheric temperature on the outside of the vehicle, an atmospheric pressure on the outside of the vehicle, an altitude and an absolute position (latitude/longitude) in the periphery of the vehicle, etc. correspond to such peripheral information. Also, when the peripheral information are to be recorded, various sensors for sensing the peripheral information are provided individually to the recording apparatus 4. Thus, the recording apparatus 4 can record the peripheral information by getting the sensor-sensed signals output from these sensors. In this case, when the sensors capable of sensing these information (e.g., thermometer, GPS, etc.) are fitted on the vehicle side, these output signals may be utilized.

Then, when the trigger conditions are satisfied during the data collection, the vehicle data recorded in the RAM 7 are recorded in the data storing section 8 according to the acquiring conditions. For example, in the mode file A shown in FIG. 4, it is decided that the trigger conditions are satisfied when the acquired engine speed becomes 0 rpm. In this case, the vehicle data over 5 minute before the timing at which the trigger conditions are satisfied are read from the RPM 7 and then recorded in the data storing section 8. In addition to this, the vehicle data recorded in the RAM 7 over 5 minute after the timing at which the trigger conditions are satisfied are also recorded in the data storing section 8.

Figure 5:
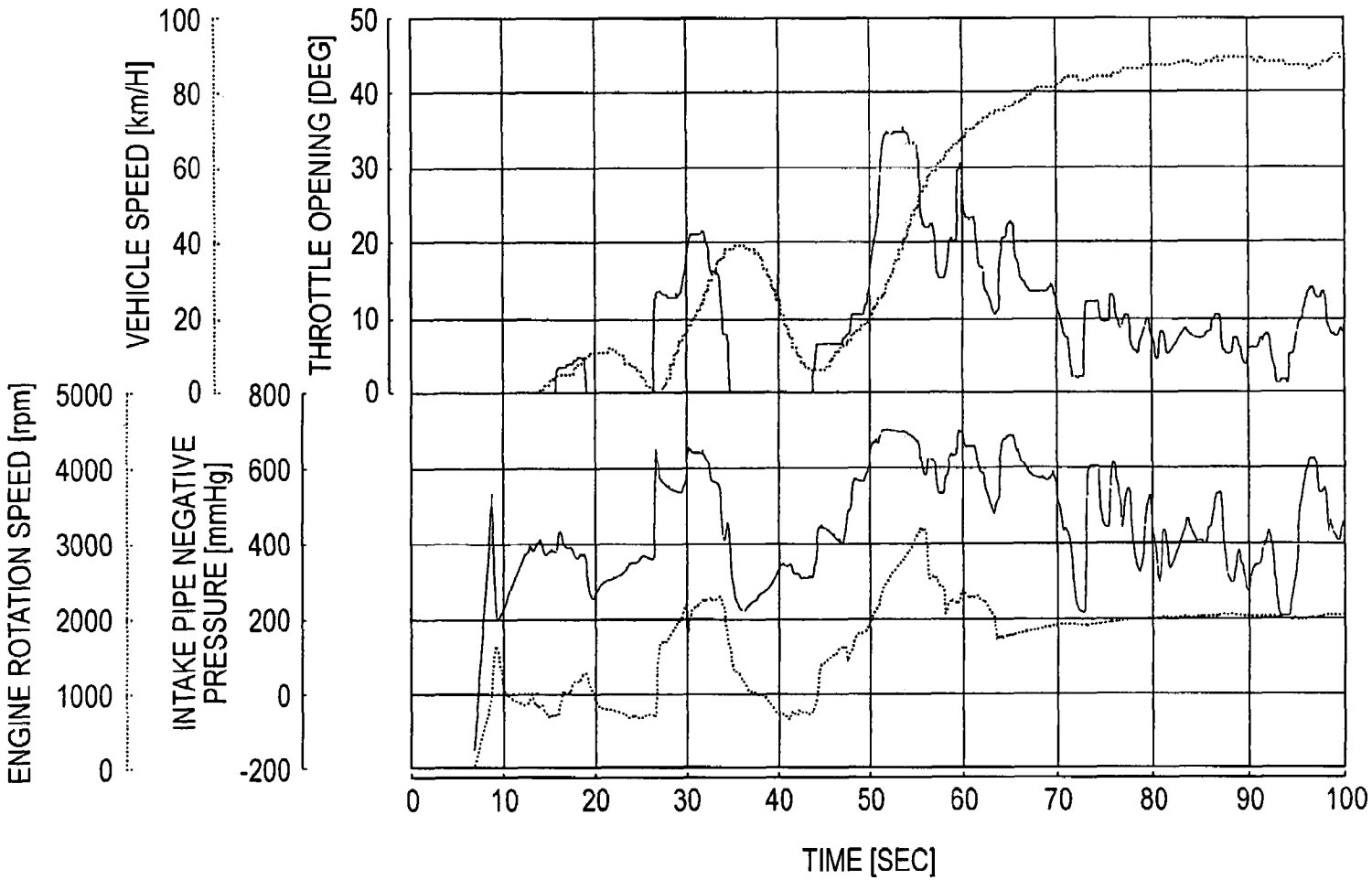
FIG. 5 is an explanatory view showing chronological transitions of vehicle data recorded in a data recording section.

FIG. 5 is an explanatory view showing chronological transitions of the vehicle data recorded in the data recording section 8. In FIG. 5, a speed (km/h), a throttle opening angle (deg), an engine speed (rpm), and an intake pipe negative pressure (mmHg) are shown as the vehicle data. As shown in FIG. 5, the vehicle data recorded in the data recording section 8 are recorded to correlate with the time information upon the collection. As this time information, either an absolute time indicated by date/time or a relative time indicated by the time elapsed from the recording start is employed.

Then, the ECU 1 executes a shut-down process at the same timing as that at which the ignition switch 12 is turned OFF by the driver or, an end timing that is set later than that timing by a predetermined period of time. More particularly, the ECU 1 stops the transmission of the control parameters to the recording apparatus 4 and also records the transmission states at the time of shutdown, i.e., the information about which type control parameters are transmitted by which transmitting method as the communication history. In the meanwhile, when the transmission of the control parameters from the ECU 1 is interrupted, the recording apparatus 4 decided that the driving of the vehicle is stopped, then executes the shutdown process such that the recording apparatus 4 can shut down the power supply safety, and then shuts down the power supply.

According to the present embodiment, the transmission state of the transmitting section 1*b*, which transmits the control parameters, at the time of shutdown are stored in the storing section 1*c* as the communication history. When the communication history is stored in the storing section 1*c*, the instruction to the effect that the transmission state should be continued is issued from the recording apparatus 4 in the starting process executed after the power supply is turned ON, and then the transmission state at the time of shutdown is restored based on the stored communication history. In this fashion, because the communication state at the time of shutdown is restored by the ECU 1 itself, the responsibility of the data communication between the recording apparatus 4 and the ECU 1 can be improved rather than the case where the transmission state is set based on the instruction from the recording apparatus 4. Therefore, the ECU 1 can execute the data acquisition immediately after the ECU 1 is started. As a result, the recording apparatus 4 can record the necessary data without fail and also the reliability of the recorded data can be improved.

In this case, in the present embodiment, when the ECU 1 receives the data request signal transmitted from the recording apparatus 4, such ECU 1 restores the transmission state. However, since a possibility of user's changing the mode file is low in the recording apparatus 4 that is installed once into the vehicle, the ECU 1 itself may restore automatically the transmission state in the starting process without reception of the data request signal. Therefore, the ECU 1 is able to transmit the control parameters to the recording apparatus 4 immediately after the ECU 1 itself is started. As a result, the responsibility of the data communication between the recording apparatus 4 and the ECU 1 can be improved much more.

In this case, the data recording section 8 in the recording apparatus 4 is not limited to the flash memory type memory card, and various recording media such as magnetic recording medium, optical recording medium, etc. may be applied widely. In this case, the vehicle data recorded in the RAM 7 are recorded on the recording media via various drives controlled by the CPU 5. In other words, the data recording section 8 in the present invention is not always provided as the constituent element of the recording apparatus 4. The recording apparatus 4 will suffice if such system can record the vehicle data at least on the data recording section 8. In this case, it is not always needed that the data recording section 8 should be detachably attached, and the data recording section 8 may be provided integrally with the recording apparatus 4.

It will be understood to those skilled in the art that various modifications and variations can be made to the described preferred embodiments of the present invention without departing from the spirit or scope of the invention. Thus, it is intended that the present invention cover all modifications and variations of this invention consistent with the scope of the appended claims and their equivalents.

What is claimed is:

1. A control unit capable of transmitting/receiving information to/from a data recording apparatus to execute control of a vehicle, comprising:

a receiving section that receives a data request signal transmitted from the data recording apparatus;

a transmitting section that transmits a control parameter, which corresponds to the data request signal, out of control parameters used to execute the control of the vehicle, to the data recording apparatus; and a storing section that stores an operating history including an operating state of the data recording apparatus at a time of shutdown, the operating state comprising acquired contents including types of control parameters to be recorded in the data recording apparatus and at least one of acquiring conditions including a sampling rate, trigger conditions, and a recording time, wherein, when the operating history is stored in the storing section, the transmitting section reads the operating history from the storing section in a starting process executed after a power supply is turned ON, and wherein the transmitting section restores the operating state at the time of shutdown based on the read operating history.

2. The control unit according to claim 1, wherein, when the receiving section receives a signal to continue the operating state from the data recording apparatus, the transmitting section restores the operating state.

3. The control unit of claim 1, wherein operating state comprises an identification of a method of transmitting said control data to said data recording apparatus.

4. A controller that communicates control data to a data recorder in a vehicle, comprising:

a receiver that receives a data request signal from the data recorder;

a transmitter that transmits control data to the data recorder; and a storage that stores an operating history including an operating state of the data recorder at a shutdown, the operating state comprising acquired contents including types of control parameters to be recorded in the data recorder and at least one of acquiring conditions including a sampling rate, trigger conditions, and a recording time.

5. The controller of claim 4, wherein the transmitter reads the operating history from the storage in a starting process.

6. The controller of claim 5, wherein the transmitter reads the operating history from the storage in a starting process in response to power being supplied to the controller.

7. The controller of claim 4, wherein the transmitter restores the operating state based upon the operating history.

8. The controller of claim 4, wherein the operating state comprises an identification of a method of transmitting said control data to said data recorder.

9. The controller of claim 4, wherein the transmitter transmits control data to the data recorder in response to the receiver receiving the data request signal.

10. A controller that communicates control data to a data recorder in a vehicle, comprising:

means for receiving a data request signal from the data recorder;

means for transmitting control data to the data recorder; and means for storing an operating history including an operating state of the data recorder at a shutdown, the operating state comprising acquired contents including types of control parameters to be recorded in the data recorder and at least one of acquiring conditions including a sampling rate, trigger conditions, and a recording time.

11. The controller of claim 10, wherein the operating state comprises an identification of a method of transmitting said control data to said data recorder.

12. The controller of claim 10, wherein said means for transmitting reads the operating history from the storage in a starting process.

13. The controller of claim 12, wherein the means for transmitting reads the operating history from the storage in a starting process in response to power being supplied to the controller.

14. The controller of claim 10, wherein the means for transmitting restores the operating state based upon the communication history.

15. The controller of claim 10, wherein the means for transmitting transmits control data to the data recorder in response to the means for receiving the data request signal.

* * * * *